US008061426B2

(12) United States Patent
Surjaatmadja

(10) Patent No.: US 8,061,426 B2
(45) Date of Patent: Nov. 22, 2011

(54) SYSTEM AND METHOD FOR LATERAL WELLBORE ENTRY, DEBRIS REMOVAL, AND WELLBORE CLEANING

(75) Inventor: Jim B. Surjaatmadja, Duncan, OK (US)

(73) Assignee: Halliburton Energy Services Inc., Duncan, OK (US)

( * ) Notice: Subject to any disclaimer, the term of this patent is extended or adjusted under 35 U.S.C. 154(b) by 131 days.

(21) Appl. No.: 12/639,244

(22) Filed: Dec. 16, 2009

(65) Prior Publication Data

US 2011/0139457 A1 Jun. 16, 2011

(51) Int. Cl.
*E21B 37/00* (2006.01)
*E21B 21/12* (2006.01)
*E21B 29/00* (2006.01)

(52) U.S. Cl. ..... 166/298; 166/223; 166/311; 166/384; 175/61; 175/67

(58) Field of Classification Search ..... None
See application file for complete search history.

(56) References Cited

U.S. PATENT DOCUMENTS

| | | | |
|---|---|---|---|
| 3,273,645 | A | 9/1966 | Der Mott |
| 4,410,051 | A | 10/1983 | Daniel et al. |
| 4,438,810 | A | 3/1984 | Wilkinson |
| 5,020,591 | A | 6/1991 | Shore |
| 5,107,927 | A | 4/1992 | Whiteley et al. |
| 5,259,466 | A | 11/1993 | Venditto et al. |
| 5,273,121 | A | 12/1993 | Kitney et al. |
| 6,213,205 | B1 | 4/2001 | Surjaatmadja |
| 6,283,208 | B1 | 9/2001 | George et al. |
| 6,336,502 | B1 | 1/2002 | Surjaatmadja et al. |
| 6,662,874 | B2 | 12/2003 | Surjaatmadja et al. |
| 6,725,933 | B2 | 4/2004 | Middaugh et al. |
| 6,938,690 | B2 | 9/2005 | Surjaatmadja |
| 6,976,507 | B1 | 12/2005 | Webb et al. |
| 7,278,491 | B2 | 10/2007 | Scott |
| 7,404,416 | B2 | 7/2008 | Schultz et al. |

(Continued)

FOREIGN PATENT DOCUMENTS

| | | | |
|---|---|---|---|
| EP | 0313374 | A1 | 4/1989 |

(Continued)

OTHER PUBLICATIONS

Nakhwa, A. D., et al., "Oriented perforating using abrasive fluids through coiled tubing," SPE 107061, 2007, pp. 1-7, Society of Petroleum Engineers.

(Continued)

*Primary Examiner* — Zakiya W Bates
(74) *Attorney, Agent, or Firm* — John W. Wustenberg; Conley Rose, P.C.

(57) ABSTRACT

A method of servicing a wellbore comprises running a toolstring into a wellbore to a first depth, actuating a controllably rotating sub-assembly of the toolstring to rotate, and activating a pressure activated bendable sub-assembly of the toolstring to bend, wherein actuating the controllably rotating sub-assembly to rotate and activating the pressure activate bendable sub-assembly are performed in any sequence or concurrently. The method also comprises running the toolstring into the wellbore beyond the first depth and stabbing the toolstring into a window in a wall of the wellbore to enter a lateral wellbore, wherein no whipstock is used to facilitate stabbing into the window. The method further includes running the toolstring into the lateral wellbore and performing a wellbore servicing operation in the lateral wellbore.

20 Claims, 7 Drawing Sheets

U.S. PATENT DOCUMENTS

| | | | | |
|---|---|---|---|---|
| 7,497,259 | B2 | 3/2009 | Leising et al. | |
| 7,617,871 | B2 | 11/2009 | Surjaatmadja | |
| 7,886,842 | B2 | 2/2011 | Howard et al. | |
| 2005/0115741 | A1 * | 6/2005 | Terry et al. | 175/61 |
| 2006/0086507 | A1 | 4/2006 | Surjaatmadja et al. | |
| 2011/0192599 | A1 | 8/2011 | Surjaatmadja et al. | |

FOREIGN PATENT DOCUMENTS

| | | | |
|---|---|---|---|
| WO | 2010064010 | A2 | 6/2010 |
| WO | 2010064010 | A3 | 6/2010 |

OTHER PUBLICATIONS

Foreign communication from a related counterpart application—International Search Report and Written Opinion, PCT Application PCT/GB2009/002808, Aug. 2, 2010, 12 pages.

Surjaatmadja, Jim B., et al., "An effective sweep-cleaning of large deviated wellbores using small coiled-tubing systems," SPE 94102, 2005, pp. 1-9, Society of Petroleum Engineers.

* cited by examiner

SYSTEM AND METHOD FOR LATERAL WELLBORE ENTRY, DEBRIS REMOVAL, AND WELLBORE CLEANING

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbons may be produced from wellbores drilled from the surface through a variety of producing and non-producing formations. The wellbore may be drilled substantially vertically or may be an offset well that is not vertical and has some amount of horizontal displacement from the surface entry point. In some cases, a multilateral well may be drilled comprising a plurality of wellbores drilled off of a main wellbore, each of which may be referred to as a lateral wellbore. Portions of lateral wellbores may be substantially horizontal to the surface. In some provinces, wellbores may be very deep, for example extending more than 10,000 feet from the surface.

A variety of servicing operations may be performed on a wellbore after it has been initially drilled. A lateral junction may be set in the wellbore at the intersection of two lateral wellbores and/or at the intersection of a lateral wellbore with the main wellbore. A casing string may be set and cemented in the wellbore. A liner may be hung in the casing string. The casing string may be perforated by firing a perforation gun. A packer may be set and a formation proximate to the wellbore may be hydraulically fractured. A plug may be set in the wellbore. A wellbore may be cleaned out or swept to remove fines, debris, and/or damage that has entered the wellbore. Those skilled in the art may readily identify additional wellbore servicing operations. In many servicing operations, a downhole tool is conveyed into the wellbore to accomplish the needed wellbore servicing operation, for example by some triggering event initiating one or more functions of the downhole tool.

SUMMARY

In an embodiment, a method of servicing a wellbore is disclosed. The method comprises running a toolstring into a wellbore to a first depth, actuating a controllably rotating sub-assembly of the toolstring to rotate, and activating a pressure activated bendable sub-assembly of the toolstring to bend, wherein actuating the controllably rotating sub-assembly to rotate and activating the pressure activate bendable sub-assembly are performed in any sequence or concurrently. The method also comprises running the toolstring into the wellbore beyond the first depth and stabbing the toolstring into a window in a wall of the wellbore to enter a lateral wellbore, wherein no whipstock is used to facilitate stabbing into the window. The method further includes running the toolstring into the lateral wellbore and performing a wellbore servicing operation in the lateral wellbore.

In another embodiment, a method of servicing a wellbore is disclosed. The method comprises running a toolstring into the wellbore on coiled tubing to a first depth and activating a rotating sub-assembly of the toolstring to rotate a bendable tool coupled to the rotating sub-assembly and to rotate a wellbore servicing sub-assembly coupled to a downhole end of the bendable tool. The method further comprises applying fluid pressure to actuate the bendable tool to bend, whereby the wellbore servicing sub-assembly is maintained in substantially continuous contact with a wall of the wellbore. Activating the rotating sub-assembly of the toolstring to rotate and applying fluid pressure to actuate the bendable tool to bend are performed in any sequence or concurrently. The method also comprises, while the rotating sub-assembly rotates the bendable tool and the wellbore servicing sub-assembly and while the bendable tool maintains the wellbore servicing sub-assembly in substantially continuous contact with the wall of the wellbore, running the toolstring into the wellbore on coiled tubing to a window in the wall of the wellbore and stabbing the toolstring into the window. The method also comprises running the toolstring into a lateral wellbore accessed through the window and performing a wellbore servicing operation in the lateral wellbore.

In an embodiment, a method of servicing a wellbore is disclosed. The method comprises running a toolstring into a wellbore to a first depth and, after the toolstring has reached the first depth, applying fluid pressure to actuate a bendable tool sub-assembly of the toolstring to bend, whereby a downhole end of the toolstring is maintained in substantially continuous contact with a wall of the wellbore. The method further comprises, while the bendable tool maintains the downhole end of the toolstring in substantially continuous contact with the wall of the wellbore, running the toolstring further into the wellbore to stab into a lateral wellbore through a window in the wall of the wellbore, wherein no whipstock device is used to facilitate stabbing into the lateral wellbore. The method further comprises performing a cleaning operation in the lateral wellbore using at least a first cleaning tool sub-assembly of the toolstring and removing the toolstring from the wellbore, whereby the method is performed in a single wellbore trip.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation such as horizontally and/or vertically spaced portions of the same formation. The various characteristics mentioned above, as well as other features and characteristics described in more detail below, will be readily apparent to those skilled in the art with the aid of this disclosure upon reading the following detailed description of the embodiments, and by referring to the accompanying drawings.

Figure 1:
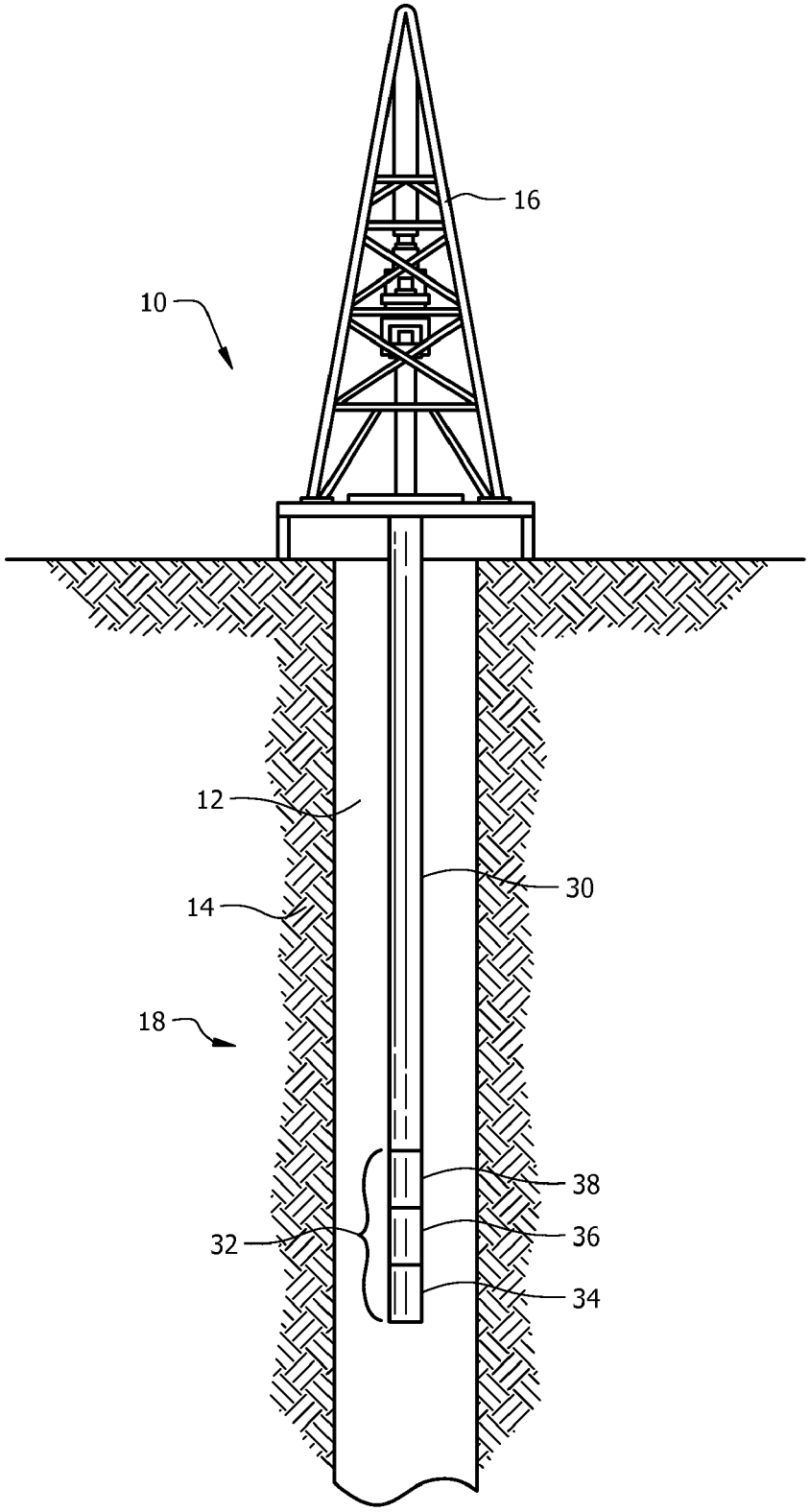
FIG. 1 illustrates a wellbore, a conveyance, and a toolstring according to an embodiment of the disclosure.

Turning now to FIG. 1, a wellbore servicing system 10 is described. The system 10 comprises a servicing rig 16 that extends over and around a wellbore 12 that penetrates a subterranean formation 14 for the purpose of recovering hydrocarbons, storing hydrocarbons, disposing of carbon dioxide, or the like. The wellbore 12 may be drilled into the subterranean formation 14 using any suitable drilling technique. While shown as extending vertically from the surface in FIG. 1, in some embodiments the wellbore 12 may be deviated, horizontal, and/or curved over at least some portions of the wellbore 12. The wellbore 12 may be cased, open hole, contain tubing, and may generally comprise a hole in the ground having a variety of shapes and/or geometries as is known to those of skill in the art.

The servicing rig 16 may be one of a drilling rig, a completion rig, a workover rig, a servicing rig, or other mast structure and supports a workstring 18 in the wellbore 12, but in other embodiments a different structure may support the workstring 18, for example an injector head of a coiled tubing rigup. In an embodiment, the servicing rig 16 may comprise a derrick with a rig floor through which the workstring 18 extends downward from the servicing rig 16 into the wellbore 12. In some embodiments, such as in an off-shore location, the servicing rig 16 may be supported by piers extending downwards to a seabed. Alternatively, in some embodiments, the servicing rig 16 may be supported by columns sitting on hulls and/or pontoons that are ballasted below the water surface, which may be referred to as a semi-submersible platform or rig. In an off-shore location, a casing may extend from the servicing rig 16 to exclude sea water and contain drilling fluid returns. It is understood that other mechanical mechanisms, not shown, may control the run-in and withdrawal of the workstring 18 in the wellbore 12, for example a draw works coupled to a hoisting apparatus, a slickline unit or a wireline unit including a winching apparatus, another servicing vehicle, a coiled tubing unit, and/or other apparatus.

In an embodiment, the workstring 18 may comprise a conveyance 30 and a toolstring 32. The toolstring 32 may comprise one or more downhole tools 34, a pressure activated bendable tool 36, and a controllable rotatable tool 38. The conveyance 30 may be any of a string of jointed pipes, a slickline, a coiled tubing, a wireline, and other conveyances for the toolstring 32. In another embodiment, the workstring 18 may comprise additional downhole tools located above or below the pressure activated bendable tool 36. For example, in some embodiments wherein the conveyance 30 is a slickline or a wireline, the workstring 18 may further comprise a device to generate pressure for activating the pressure activated bendable tool 36, for example an electrical pump, a container charged with a pressurized fluid, and/or other pressure sourcing apparatus.

Figure 2:
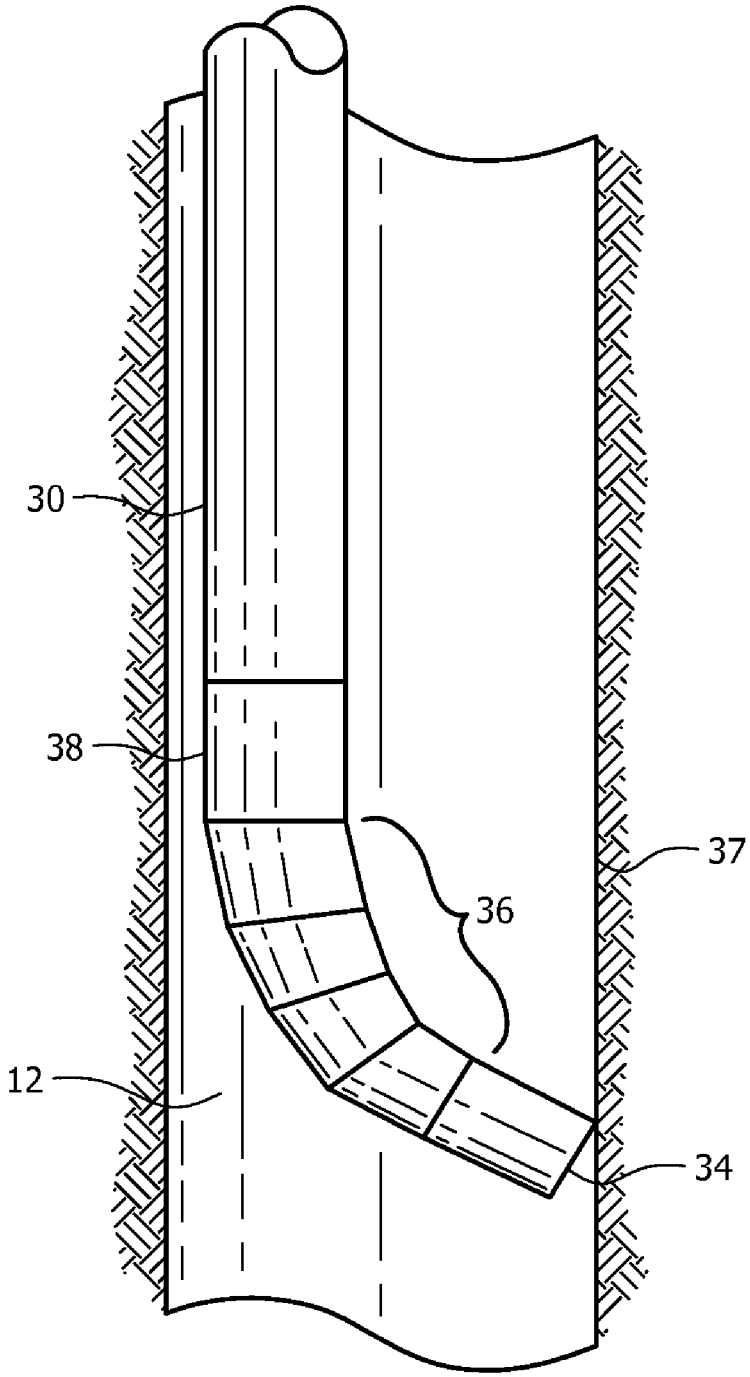
FIG. 2 illustrates a toolstring in an actuated mode in the wellbore according to an embodiment of the disclosure.

Turning now to FIG. 2, an activated state of the pressure activated bendable tool 36 is discussed. The pressure activated bendable tool 36 may be referred to in some contexts as a pressure bendable sub-assembly or bendable sub-assembly. In an embodiment, when fluid pressure is applied to an interior of the workstring 18 the fluid pressure and a corresponding fluid flow may pass through interior chambers of each of the controllable rotatable tool 38, the pressure activated bendable tool 36, and the downhole tool 34. When the pressure activated bendable tool 36 is subjected to fluid pressure, the pressure activated bendable tool 36 activates and bends in an arc off of the center axis of the wellbore 12, displacing the downhole tool 34 into contact with a wall 37 of the wellbore 12. In an embodiment, the bending motion of the pressure activated bendable tool 36 is constrained substantially to motion in a plane by nesting slots and ribs of segments of the pressure activated bendable tool 36. Further details of one or more embodiments of the pressure activated bendable tool 36 are described in U.S. Pat. No. 6,213,205 B1, titled "Pressure Activated Bendable Tool," by Jim B. Surjaatmadja, which is hereby incorporated by reference for all purposes. Further information related to the pressure activated bendable tool 36 may be found in U.S. Pat. No. 6,938,690 B2, titled "Downhole Tool and Method for Fracturing a Subterranean Well Formation," by Jim B. Surjaatmadja, which is hereby incorporated by reference for all purposes. In an embodiment, when fluid flow passes through the controllable rotatable tool 38, the controllable rotatable tool 38 rotates, rotating in turn the pressure activated bendable tool 36 that is coupled directly or indirectly to the controllable rotatable tool 38. Similarly, the rotating pressure activated bendable tool 36 rotates in turn the downhole tool 34 coupled directly or indirectly to the pressure activated bendable tool 36, sweeping the end of the downhole tool 34 around the wall 37 of the wellbore 12, maintaining substantially continuous contact between the end of the downhole tool 34 and the wall 37 of the wellbore 12. Further details of one or more embodiments of the controllable rotatable tool 38 are described in U.S. Pat. No. 6,336,502 B1, titled "Slow Rotating Tool with Gear Reducer," by Jim B. Surjaatmadja et al., which is hereby incorporated by reference for all purposes.

In an embodiment, the workstring 18 may be run into the wellbore 12 to a first depth without applying fluid pressure into the workstring 18, where the first depth is above a depth of one or more windows in the wall 37 of the wellbore 12 opening into one or more lateral wellbores. In some circumstances, for example in inexpensive wellbores where logging may not have been preformed and/or when the passage of time may have resulted in loss or misplacement of logging records, the precise depth and/or angular orientation of the windows into the lateral wellbores may not be known. When the workstring 18 achieves the first depth, surface fluid pumps may be engaged to supply fluid pressure to the workstring 18, whereby the pressure activated bendable tool 36 is activated to bend and maintain the downhole tool 34 in contact with the wall 37 of the wellbore 12. Likewise, the fluid flow drives the controllable rotatable tool 38 to rotate, thereby rotating the pressure activated bendable tool 36 and the downhole tool 34. While the fluid pressure and fluid flow are maintained, the pressure activated bendable tool 36 maintains the downhole tool 34 in contact with the wall 37 of the wellbore, and the controllable rotatable tool 38 rotates, the workstring 18 is then run further into the wellbore 12 at a rate which may be dependent on the rate at which the controllable rotatable tool 38 rotates as well as the length of a window in the wellbore 12 opening into a lateral wellbore.

Figure 3:
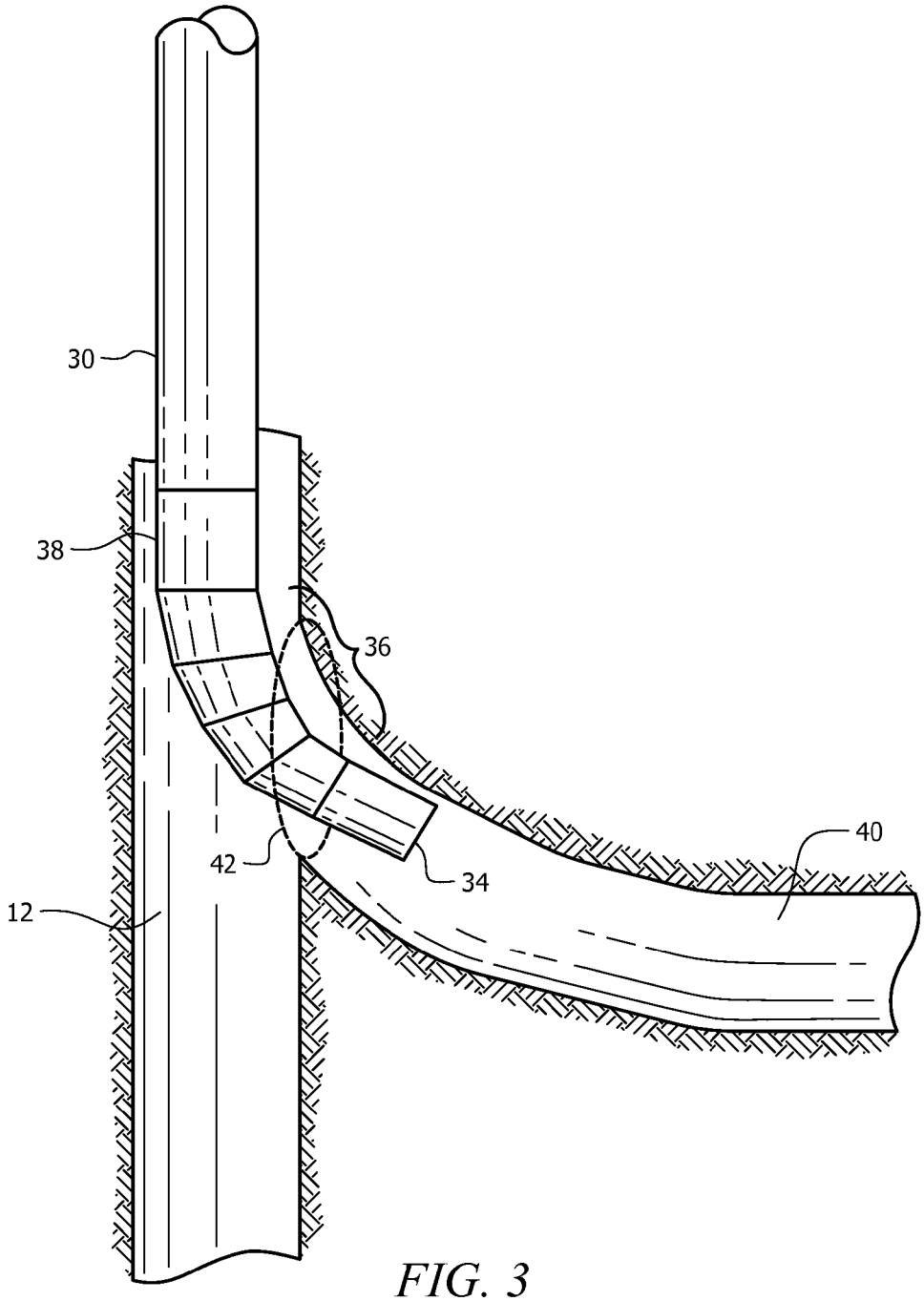
FIG. 3 illustrates the toolstring in the actuated mode stabbing into a lateral wellbore through a window in a wall of the wellbore according to an embodiment of the disclosure.

Turning now to FIG. 3, the stabbing of the downhole tool 34 and the pressure activated bendable tool 36 into a window 42 of a lateral wellbore 40 is discussed. As the downhole tool 34 is swept around the inside diameter of the wellbore 12 by the controllable rotatable tool 38, the downhole tool 34 will be swept over the opening of the window 42 in the wall 37 of the wellbore 12, and the pressure activated bendable tool 36 will bend further, stabbing the downhole tool 34 into the window 42 and into the lateral wellbore 40. As the workstring 18 continues to run into the wellbore 12, the downhole tool 34, the pressure activated bendable tool 36, the controllable rotatable tool 38, and a portion of the conveyance 30 are run into the lateral wellbore 40.

Note that if the rate of rotation of the controllable rotatable tool 38 is fast enough, the downhole tool 34 has a high probability of being swept over the window 42 and being stabbed into the lateral wellbore 40, even though the precise depth and the precise angular orientation of the window 42 may be unknown. For example, if the value of the rate of rotation of the controllable rotatable tool 38 is greater than the value of the downhole velocity of the workstring 18 divided by the length of the window 42, which can be represented by the equation $$RPM_{rotatable\ tool} > V_{feet\ per\ minute}/L_{feet} \quad \text{(equation 1)}$$

where RPM is the angular velocity imparted by the controllable rotatable tool 38 in revolutions per minute, where $V_{feet\ per\ minute}$ is the downhole velocity of the workstring 18 in feet per minute, and where $L_{feet}$ is the length of the window 42 in feet, then it can be expected that the controllable rotatable tool 38 will sweep the downhole tool 34 over the window 42 before the downhole tool 34 is carried past the window 42 by the downhole velocity of the workstring 18. It is understood that the relationship of equation 1 can be readily translated to other systems of physical units by one skilled in the art. Further note that no whipstock is needed to guide the downhole tool 34 into the window 42 and into the lateral wellbore 40. Thus, when attempting to stab the downhole tool 34 into the window 42, it may be desirable to modulate the run-in velocity based on the rate of rotation of the controllable rotatable tool 38 and based on the length of the window 42. The depth in the wellbore 12 where the window 42 is located, which may be unknown, may be referred to in some contexts as a second depth, which may be above or below a first depth.

Figure 4:
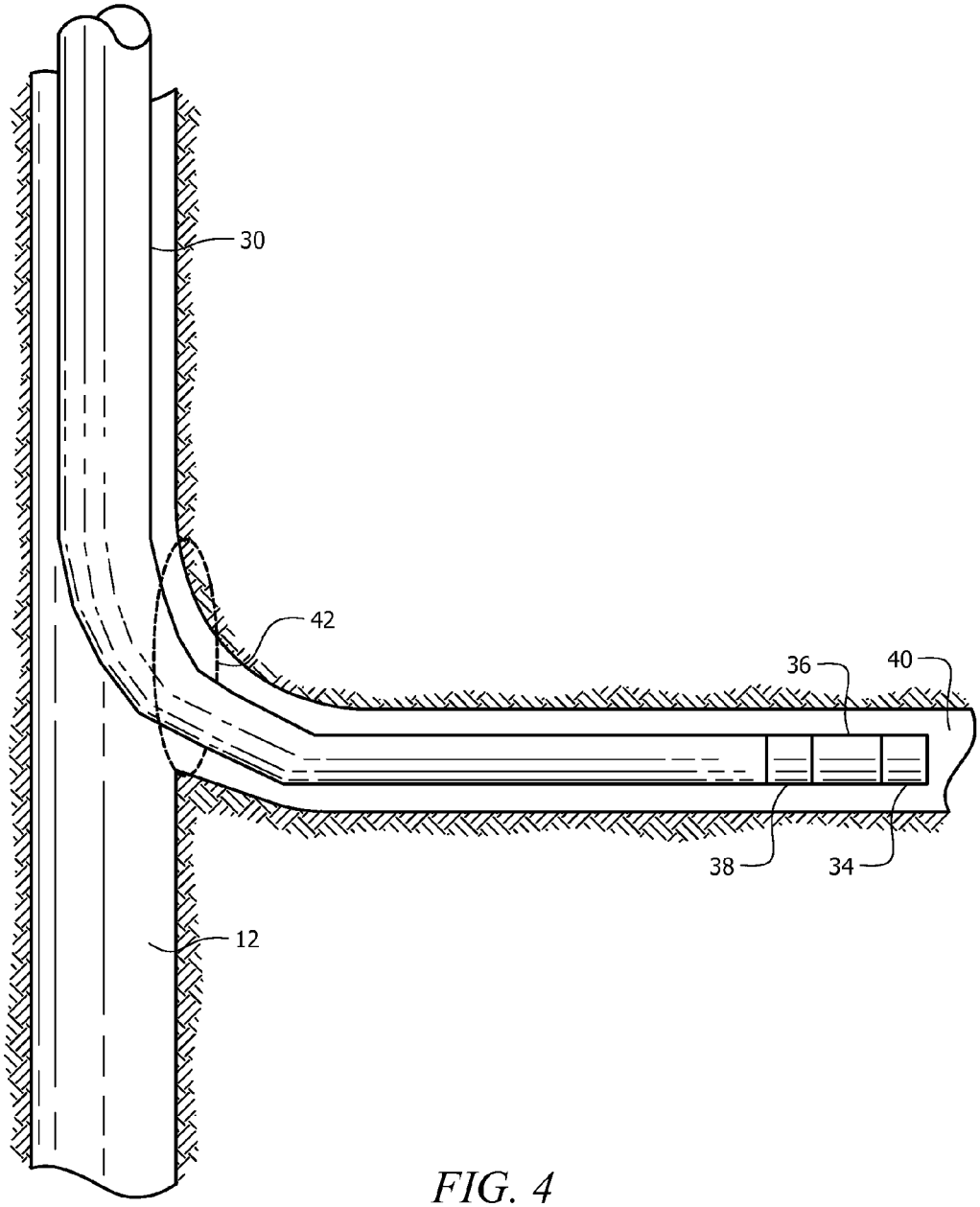
FIG. 4 illustrates the toolstring run into the lateral wellbore by the conveyance according to an embodiment of the disclosure.

Turning now to FIG. 4, the run in of the downhole tool 34 and the workstring 18 into the lateral wellbore 40 is discussed. As the workstring 18 continues to be run in, the downhole tool 34 is run in to a target depth or to a hole bottom. In an embodiment, the fluid pressure in the workstring 18 may be reduced, for example the pumps at the surface supplying fluid flow and fluid pressure to the workstring 18 may be shut off, after the toolstring 32 has been stabbed into the lateral wellbore 40. At this point a wellbore servicing operation may be performed by the downhole tool 34. Any of a variety of wellbore servicing operations may be performed or a plurality of wellbore servicing operations may be performed. In an embodiment, a plurality of downhole tools 34 serving different functions may comprise the toolstring 32 to perform a plurality of wellbore servicing operations.

In an embodiment, the downhole tool 34 may perform a wellbore cleaning service. The downhole tool 34 may be a sweeping tool that expels fluid through jets in the surface of the sweeping tool to stir up fines, sediment, drill cuttings, sand, proppant, scale, crushed portions of the formation, gun debris, and other unwanted materials, that are then suspended in the fluid and flowed to the surface for removal. In some contexts, removing such material from the lateral wellbore 40 and/or the wellbore 12 may be referred to as damage removal and/or debris removal. In some circumstances, removing damage may further refer to removing material that has reduced formation permeability and may have reduced production flow. In an embodiment, the downhole tool 34 may be designed to create a helical, backwards fluid flow that overcomes convection effects in a deviated portion of the lateral wellbore 40 (a deviated portion may be a section of the lateral wellbore that is neither substantially vertical nor substantially horizontal, where convection effects may be significant). In an embodiment, a deviated portion of the lateral wellbore 40 includes a portion that is angled at between 20 degrees and 70 degrees with reference to the surface.

Further details of one or more embodiments of a wellbore cleanout tool that generates a helical, backwards fluid flow and of a method of using the wellbore cleanout tool are described in US Patent Application Publication 2006/0086507 A1, entitled "Wellbore Cleanout Tool and Method," by Jim B. Surjaatmadja, et al., which is hereby incorporated by reference for all purposes. In an embodiment, the downhole tool 34 may include a feature at its end that generates a pulsating fluid flow or may be coupled to a second downhole tool that creates a pulsating fluid flow that promotes freeing and breaking up debris and wellbore damage so that it may be swept out of the lateral wellbore 40 by the sweeping tool. Wellbore damage and/or well damage may comprise material that has become stuck within the matrix of the production formation, reducing permeability and hence reducing production flow. In some cases, the pulsating fluid flow may free and/or help to remove damage. Further details of one or more embodiments of a tool for creating a pulsating fluid flow are described in U.S. Pat. No. 6,976,507 B1, titled "Apparatus for Creating Pulsating Fluid Flow," by Earl D. Webb et al., which is hereby incorporated by reference for all purposes and in U.S. Pat. No. 7,404,416 B2, titled "Apparatus and Method for Creating Pulsating Fluid Flow, and Method of Manufacture for the Apparatus," by Roger L. Schultz et al., which is hereby incorporated by reference for all purposes.

After the wellbore servicing procedure has been completed, the workstring 18 may be retrieved from the lateral wellbore 40 and the wellbore 12, thereby withdrawing and retrieving the controllable rotatable tool 38, the pressure activated bendable tool 36, and the downhole tool 34 from the lateral wellbore 40 and then from the wellbore 12. In an embodiment, the fluid pressure in the workstring 18 may be reduced, for example the pumps at the surface supplying fluid flow and fluid pressure to the workstring 18 may be shut off, after the wellbore servicing operation has been completed and before the workstring 18 is withdrawn from the lateral wellbore 40 and the wellbore 12. Note that the run in, the servicing procedure, and the withdrawal were accomplished with only a single trip in and out of the wellbore 12. In more conventional procedures, a preliminary trip may be necessary to first locate a whipstock at the second depth to guide the downhole tool 34 into the window 42 and the lateral wellbore 40. The present system and method obviates the need for the whipstock, thereby saving a trip into and out of the wellbore to perform a lateral wellbore servicing procedure. Further, the present system may overcome some of the problems associated with not knowing in advance the precise depth and the precise angular orientation of windows in the wall 37 opening into lateral wellbores 40, information that is likely needed for effective placement of whipstocks.

Alternatively, rather than removing the workstring 18 from the lateral wellbore 40, the controllable rotatable tool 38 and the pressure activated bendable tool 36 may be activated by fluid pressure and/or fluid flow to stab into another window in the wall of the lateral wellbore 40 to enter a second lateral off of the lateral wellbore 40 and to perform a wellbore servicing operation in the second lateral. Alternatively, rather than removing the workstring 18 from the wellbore 12, the controllable rotatable tool 38 and the pressure activated bendable tool 36 may be activated by fluid pressure and/or fluid flow to stab into another window in the wall 37 of the wellbore 12 to enter a third lateral off of the wellbore 12 and to perform a wellbore servicing operation in the third lateral, e.g., above or below the first window 42.

Without limitation, in an embodiment, the system and method taught by the present disclosure may be used in coal bed methane wells. In an embodiment, the system and method taught by the present disclosure may be used in wells having lateral wellbores that are proximate to each other, for example when the laterals are drilled into production zones that may be thin and located closely on top of each other, because in such circumstances the use of whipstocks may be prohibited by the proximity of the lateral wellbores to each other. In an embodiment, the system and method taught by the present disclosure may be used to advantage when precise information about the depth and/or the angular orientation of windows into laterals, for example the window 42, was never reliably determined, has been subsequently lost, or otherwise is unavailable for use in stabbing the downhole tool 34 into the window 42. In some circumstances, precise information about the depth and/or angular orientation of windows into laterals may be lost over time, for example due to misplaced data and/or due to transferral of ownership of the wellbore 12.

Figure 5:
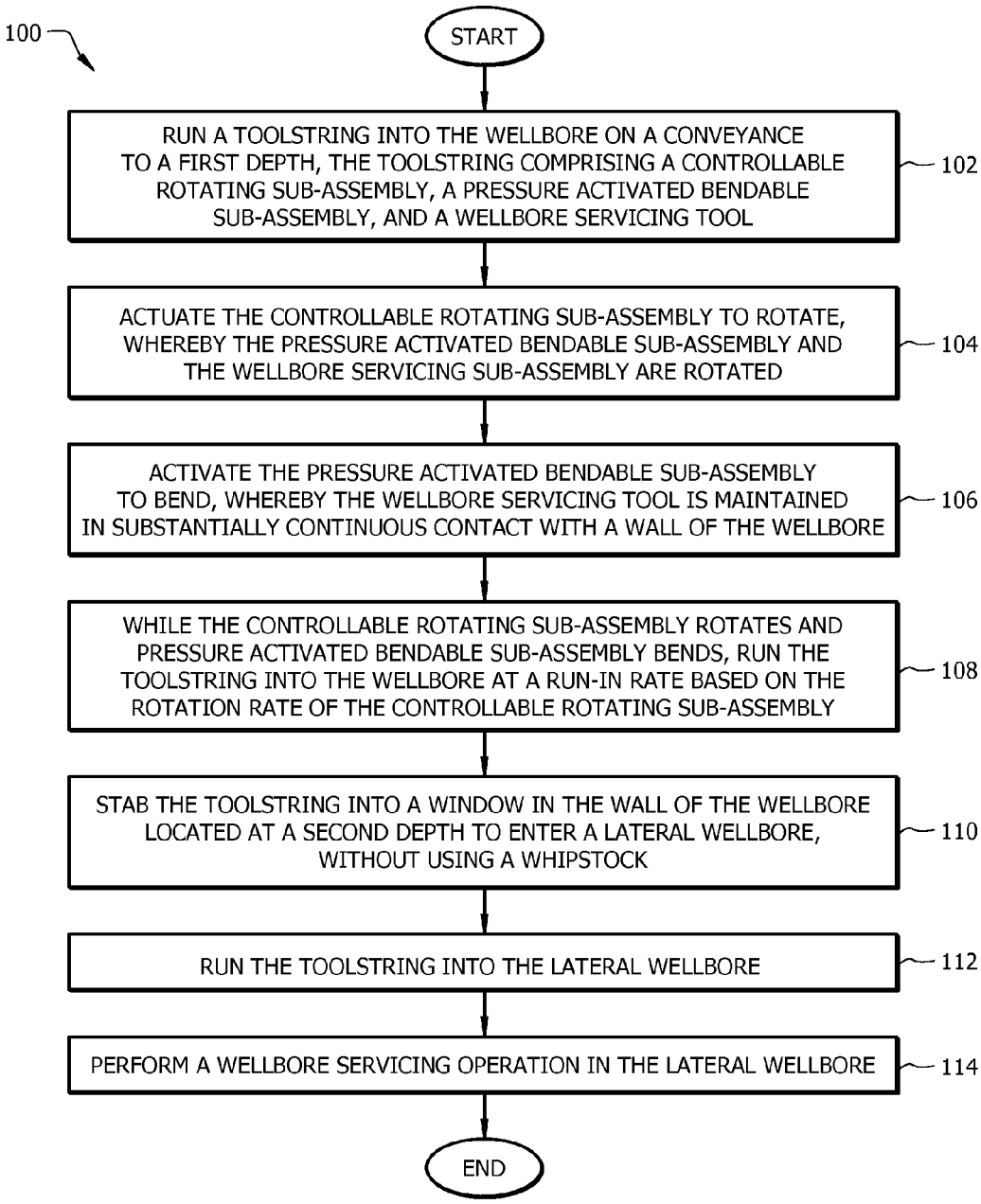
FIG. 5 is an illustration of a method according to an embodiment of the disclosure.

Turning now to FIG. 5, a method 100 of servicing a wellbore is described. At block 102, the toolstring 32 is run into the wellbore 12 on a conveyance to a first depth. At block 104, the controllable rotating tool 38 is actuated to rotate, whereby the pressure activated bendable tool 36 and the downhole tool 34 are rotated. At block 106, the pressure activated bendable tool 36 is activated by fluid pressure in the workstring 18, whereby the downhole tool 34 is maintained in substantially continuous contact with the wall 37 of the wellbore 12, at least until the toolstring 30 is stabbed into the window 42 of the lateral wellbore 40. Note that the processing of blocks 104 and 106 may be performed in any sequence and/or concurrently.

At block 108, while the controllable rotatable tool 38 rotates and while the pressure activated bendable tool 36 bends, the toolstring 32 is run into the wellbore 12 at a run-in rate based on the rotation rate of the controllable rotating tool 38, as described further above. In an embodiment, the rotation rate of the controllable rotating tool 38 is also based on an assumed length of the window 42, as described further above.

At block 110, the toolstring 32 is stabbed into the window 42 in the wall 37 of the wellbore 12 located at the second depth to enter the lateral wellbore 40. Note that no whipstock has been used to guide the toolstring 30 through the window 42 and into the lateral wellbore 40. At block 112, the toolstring 32 is run into the lateral wellbore 40, for example to a target depth and/or to a bottom of hole in the lateral wellbore 40. At block 114, a wellbore servicing operation is performed in the lateral wellbore 40. For example, a wellbore servicing operation is performed by the downhole tool 34. In an embodiment, a cleanout procedure may be performed by the downhole tool 34 to remove accumulated fines, sediment, sand, proppant, debris, gun debris, scale, drill cuttings, and/or other unwanted materials. The method 100 may be practiced after the lateral wellbore 40 has been on-line in a production mode for an extended period of time, for example for one or more years. In the case of an uncased lateral wellbore, for example, over time unwanted materials may accumulate as hydrocarbons propagate out of the formation 18.

Figure 6:
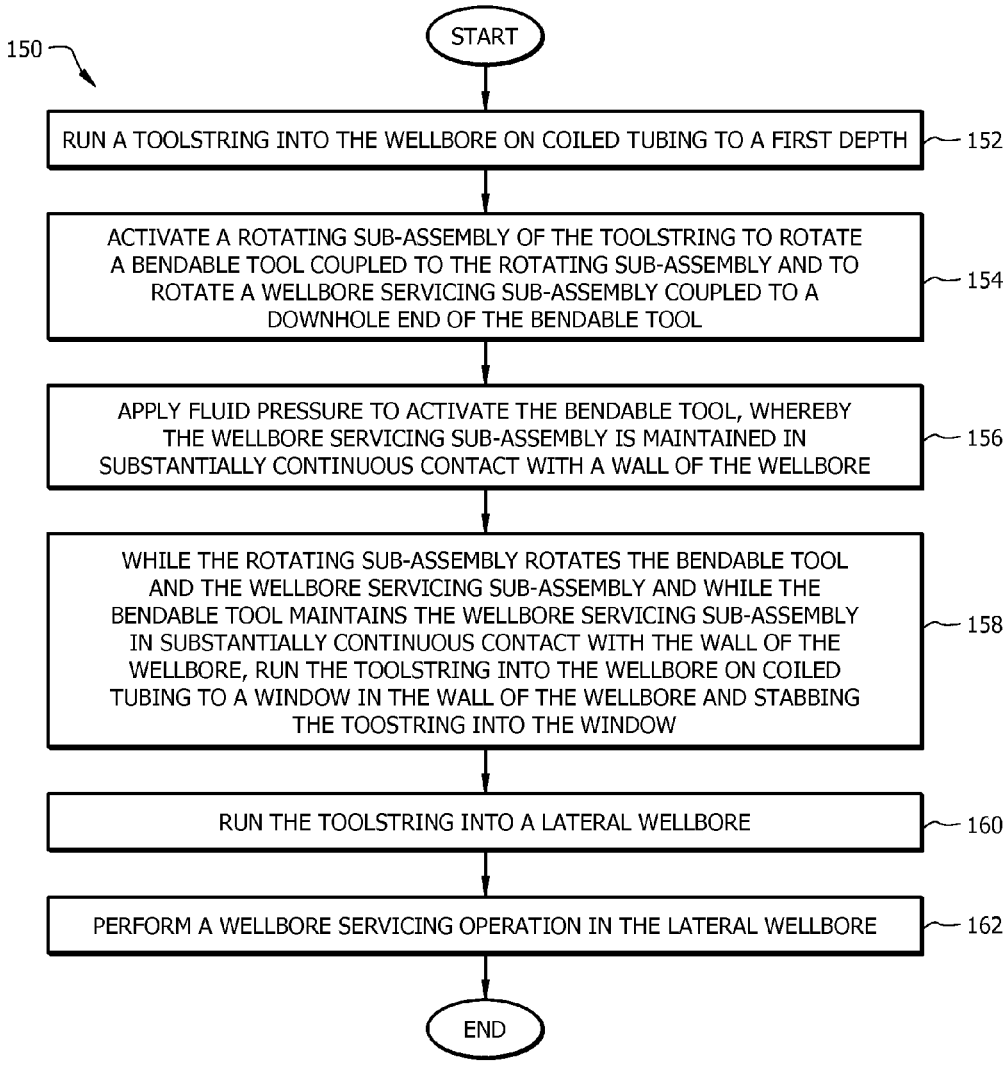
FIG. 6 is an illustration of another method according to an embodiment of the disclosure.

Turning now to FIG. 6, a method 150 is described. At block 152, the toolstring 32 is run into the wellbore 12 on the conveyance 30 to the first depth, where the conveyance 30 may be coiled tubing. At block 154, the controllable rotatable tool 38 is activated to rotate the pressure activated bendable tool 36 that is coupled, directly or indirectly, to the controllable rotatable tool 38. The controllable rotatable tool 38 also rotates the downhole tool 34 that is coupled directly or indirectly to the pressure activated bendable tool 36. At block 156, fluid pressure is applied to the workstring 18 and thereby to the pressure activated bendable tool 36, whereby the pressure activated bendable tool 36 bends and maintains the downhole tool 34 in substantially continuous contact with the wall 37 of the wellbore 12, at least until the toolstring 32 had been stabbed through the window 42 in the wall 37 of the wellbore 12 and into the lateral wellbore 40. Note that the processing of blocks 154 and 156 may be performed in any sequence and/or concurrently.

At block 158, while the controllable rotating tool 38 rotates and while the pressure activated bendable tool 36 maintains the downhole tool 34 in substantially continuous contact with the wall 37 of the wellbore 12, the toolstring 32 is run into the wellbore 12 on conveyance 30 to the window 42 in the wall 37 of the wellbore 12 and the toolstring 12 is stabbed into the window 42 and into the lateral wellbore 40. For example, as the downhole tool 34 is rotated over the window 42, the pressure activated bendable tool 36 bends further, driving the downhole tool 34 through the window 42 in the wall 37 of the wellbore 12 and into the lateral wellbore 40.

At block 160, the toolstring 32 is run into the lateral wellbore 40. For example the toolstring 32 is run into the lateral wellbore 40 to a target depth and/or to a bottom of hole of the lateral wellbore 40. At block 162, a wellbore servicing operation is performed in the lateral wellbore 40. For example, in an embodiment, a lateral wellbore cleanout procedure is performed by the downhole tool 34 to remove accumulated fines, sediment, sand, proppant, debris, gun debris, scale, and/or damage from the lateral wellbore 40. After the completion of the wellbore servicing operation, the workstring 18 may be removed from the lateral wellbore 40 and the wellbore 12. Note that the wellbore servicing procedure performed by the method 150 only involved a single trip.

Figure 7:
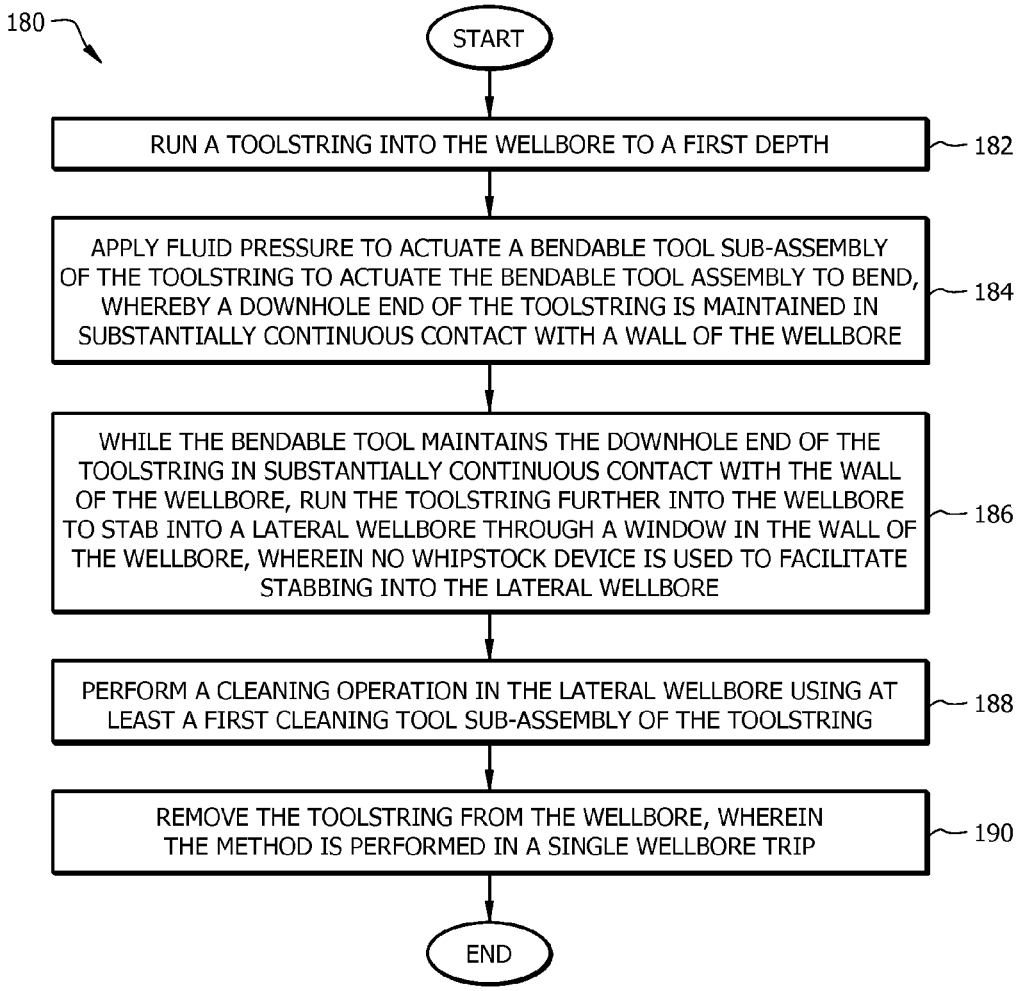
FIG. 7 is an illustration of yet another method according to an embodiment of the disclosure.

Turning now to FIG. 7, a method 180 is described. At block 182, the toolstring 32 is run into the wellbore 12 to the first depth. At block 184, fluid pressure is applied to activate the pressure activated bendable tool 36, for example, fluid pumps at the surface may pump fluid under pressure into the workstring 18. The pressure activated bendable tool 36 activates and bends, maintaining the downhole tool 34 in substantially continuous contact with the wall 37 of the wellbore 12, at least until the down hole tool 34 is stabbed through the window 42 and into the lateral wellbore 40. At block 186, while the pressure activated bendable tool 36 maintains the downhole tool 34 in substantially continuous contact with the wall 37 of the wellbore 12, the toolstring 32 is run further into the wellbore 12 to stab into the lateral wellbore 40 through the window 42 in the wall 37 of the wellbore 12, wherein no whipstock device is used to facilitate stabbing the toolstring 32 into the lateral wellbore 40.

At block 188, perform a cleaning operation in the lateral wellbore 40 using at least a first cleaning tool sub-assembly of the toolstring 32. For example, a cleaning operation is performed at the bottom of the hole of the lateral wellbore 40 and continued as the toolstring 32 is gradually removed from the lateral wellbore 40. At block 190, the toolstring 32 is removed from the lateral wellbore 40 and from the wellbore 12, wherein the method 180 is performed in a single wellbore trip.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A method of servicing a wellbore, comprising:

running a toolstring into the wellbore on a conveyance to a first depth, the toolstring comprising a controllably rotating sub-assembly, a pressure activated bendable sub-assembly, and a wellbore servicing tool;

actuating the controllably rotating sub-assembly to rotate, whereby the pressure activated bendable sub-assembly and the wellbore servicing sub-assembly are rotated;

activating the pressure activated bendable sub-assembly to bend, whereby the wellbore servicing tool is maintained in substantially continuous contact with a wall of the wellbore, wherein actuating the controllably rotating sub-assembly to rotate and activating the pressure activate bendable sub-assembly are performed in any sequence or concurrently;

while the rotating sub-assembly rotates and the pressure activated bendable sub-assembly bends, running the toolstring into the wellbore beyond the first depth;

stabbing the toolstring into a window in the wall of the wellbore located at a second depth to enter a lateral wellbore, the second depth greater than the first depth, wherein no whipstock device is used to facilitate stabbing the toolstring into the window;

running the toolstring into the lateral wellbore; and performing a wellbore servicing operation in the lateral wellbore.

2. The method of claim 1, wherein the wellbore servicing operation performed in the lateral wellbore comprises a cleaning operation.

3. The method of claim 1, wherein the wellbore servicing tool comprises a wellbore cleanout tool comprising an uphole directed and sideways angled fluid jet.

4. The method of claim 3, wherein the wellbore servicing tool comprises a tool for generating a pulsating fluid flow for wellbore damage removal.

5. The method of claim 1, wherein the wellbore servicing operation performed in the lateral wellbore comprises a hydrojetting operation.

6. The method of claim 1, wherein the conveyance on which the toolstring is run into the wellbore is coiled tubing.

7. The method of claim 1, wherein the toolstring is run into the wellbore beyond the first depth at a run-in rate based on the rotation rate of the controllably rotating sub-assembly.

8. A method of servicing a wellbore, comprising:

running a toolstring into the wellbore on coiled tubing to a first depth;

activating a rotating sub-assembly of the toolstring to rotate a bendable tool coupled to the rotating sub-assembly and to rotate a wellbore servicing sub-assembly coupled to a downhole end of the bendable tool;

applying fluid pressure to actuate the bendable tool to bend, whereby the wellbore servicing sub-assembly is maintained in substantially continuous contact with a wall of the wellbore, wherein activating the rotating sub-assembly of the toolstring to rotate and applying fluid pressure to actuate the bendable tool to bend are performed in any sequence or concurrently;

while the rotating sub-assembly rotates the bendable tool and the wellbore servicing sub-assembly and while the bendable tool maintains the wellbore servicing sub-assembly in substantially continuous contact with the wall of the wellbore, running the toolstring into the wellbore on coiled tubing to a window in the wall of the wellbore and stabbing the toolstring into the window;

running the toolstring into a lateral wellbore accessed through the window; and performing a wellbore servicing operation in the lateral wellbore.

9. The method of claim 8, wherein the wellbore servicing operation comprises a sweeping operation to remove at least one of debris, drill cuttings, scale, crushed portions of formation, gun debris, proppant, sand, and fines from the lateral wellbore.

10. The method of claim 8, wherein the toolstring comprises a tool for generating a pulsating fluid flow.

11. The method of claim 8, wherein the lateral wellbore is uncased.

12. The method of claim 8, wherein stabbing the toolstring into the window does not use a whipstock set proximate to the window to direct the toolstring into the window.

13. The method of claim 8, wherein the lateral wellbore is located in a coal bed methane formation.

14. A method of servicing a wellbore, comprising:

running a toolstring into a wellbore to a first depth;

applying fluid pressure to actuate a bendable tool sub-assembly of the toolstring to bend, whereby a downhole end of the toolstring is maintained in substantially continuous contact with a wall of the wellbore;

while the bendable tool maintains the downhole end of the toolstring in substantially continuous contact with the wall of the wellbore, running the toolstring further into the wellbore to stab into a lateral wellbore through a window in the wall of the wellbore, wherein no whipstock device is used to facilitate stabbing into the lateral wellbore;

performing a cleaning operation in the lateral wellbore using at least a first cleaning tool sub-assembly of the toolstring; and removing the toolstring from the wellbore, wherein the method is performed in a single wellbore trip.

15. The method of claim 14, wherein the toolstring is run into the wellbore on coiled tubing.

16. The method of claim 14, wherein the cleaning tool sub-assembly comprises a tool that generates a pulsating fluid flow.

17. The method of claim 14, wherein the cleaning operation cleans at least a deviated portion of the lateral wellbore.

18. The method of claim 17, wherein the deviated portion of the lateral wellbore includes a portion that is angled at between 20 degrees and 70 degrees with reference to the surface.

19. The method of claim 14, wherein the toolstring comprises a cleanout tool comprising an uphole directed and sideways angled fluid jet.

20. The method of claim 19, wherein the cleanout tool overcomes convective motion effects at least in a deviated portion of the lateral wellbore.

* * * * *